US006150870A

United States Patent [19]

Kang

[11] Patent Number: 6,150,870

[45] Date of Patent: Nov. 21, 2000

[54] ADJUSTABLE SUBSTRATE VOLTAGE APPLYING CIRCUIT OF A SEMICONDUCTOR DEVICE

[75] Inventor: Dong Keum Kang, Choongcheongbuk-Do, Rep. of Korea

[73] Assignee: Hyundai Electronics Industries Co., Ltd., Ichon-shi, Rep. of Korea

[21] Appl. No.: 09/195,202

[22] Filed: Nov. 18, 1998

[30] Foreign Application Priority Data

Feb. 7, 1998 [KR] Rep. of Korea ..... 3576-98

[51] Int. Cl.[7] ..... G05F 1/10

[52] U.S. Cl. ..... 327/537; 327/543; 365/189.09

[58] Field of Search ..... 327/534, 535, 327/536, 537, 541, 543; 365/189.09, 201, 206

[56] References Cited

U.S. PATENT DOCUMENTS

| | | | |
|---|---|---|---|
| 4,471,290 | 9/1984 | Yamaguchi | 327/535 |
| 5,744,997 | 4/1998 | Kang et al. | 327/534 |
| 5,767,735 | 6/1998 | Javanifard et al. | 327/536 |
| 5,838,189 | 11/1998 | Jeon | 327/525 |
| 5,929,693 | 12/1998 | Kuroda | 327/535 |
| 5,952,872 | 9/1999 | Hur | 327/537 |
| 6,011,743 | 1/2000 | Khang | 327/536 |

OTHER PUBLICATIONS

Syuso Fujii, et al., "FAM 16.6: A 45ns 16Mb DRAM with Triple–Well Structure," Session 16; IEEE International Solid–State Circuits Conference, pp. 248–249, Feb. 1989.

*Primary Examiner*—Timothy P. Callahan
*Assistant Examiner*—Terry L. Englund
*Attorney, Agent, or Firm*—Fleshner & Kim, LLP

[57] ABSTRACT

A substrate voltage applying circuit selectively controls a level of a substrate voltage supplied to a memory cell unit of a semiconductor device, for example, after fabrication. In a semiconductor device preferably fabricated by a triple-well process, a substrate voltage applying circuit of the semiconductor device can include an oscillation circuit unit that generates an oscillation signal and a pumping unit that outputs a substrate voltage based on the oscillation signal. A vendor test mode generating unit outputs sense level selecting signals by coding preferably signals that are externally supplied. A level sense unit senses a level of the substrate voltage using a plurality of preset sensing points and supplies a corresponding sensing signal to the oscillation circuit unit based on the sense level selecting signals from the vendor test mode generating unit.

17 Claims, 3 Drawing Sheets

ADJUSTABLE SUBSTRATE VOLTAGE APPLYING CIRCUIT OF A SEMICONDUCTOR DEVICE

BACKGROUND OF THE INVENTION

1. Field of the Invention

The present invention relates to a substrate voltage applying circuit for a semiconductor device, and more particularly, to a substrate voltage applying circuit that selectively generates a substrate voltage.

2. Background of the Related Art

A conventional CMOS twin-well process applied to semiconductor devices includes a P-well and an N-well that respectively receive a substrate voltage Vbb and a power source voltage Vcc. However, as the semiconductor devices become increasingly integrated, a related art triple-well process has been introduced to miniaturize the semiconductor devices and to improve reliability.

As shown in FIG. 1, in the related art triple-well process the semiconductor device includes a memory cell unit 1 having a P-well surrounded by a deep N-well and a peripheral circuit unit 2 provided with a P-well and an N-well. A ground voltage Vss and a power source voltage Vcc are supplied to the P-well and the N-well, respectively, of the peripheral circuit unit 2. The power source voltage Vcc (not shown) or a boost voltage Vpp, and a substrate voltage Vbb are supplied to the deep N-well and the P-well, respectively, of the memory cell unit 1. A related art substrate voltage applying circuit in the semiconductor device supplies the substrate voltage Vbb to the P-well of the memory cell unit 1.

FIG. 2 is a block diagram showing the related art substrate voltage applying circuit that includes an oscillation circuit 10 for generating an oscillation signal OSC and a pumping unit 20 for carrying out a voltage pumping operation in accordance with the oscillation signal OSC from the oscillation circuit 10 to generate the substrate voltage Vbb. A level sensing unit 30 senses a level of the substrate voltage Vbb outputted from the pumping unit 20 in accordance with a predetermined set sensing point and generates a sensing signal OSCSW.

The oscillation circuit 10 and the pumping unit 20 can employ conventional devices. Accordingly, a detailed description is omitted.

The level sensing unit 30 includes a sensing NMOS transistor N1 with a source and a substrate that receive the substrate voltage Vbb from the pumping unit 20. A gate of the sensing NMOS transistor N1 receives the ground voltage Vss and a drain is connected to the oscillation circuit 10. The sensing NMOS transistor N1 is located in the deep N-well of the memory cell unit 1 in FIG. 1.

With reference to FIG. 2, operation of the related art substrate voltage applying circuit will now be described. The pumping unit 20 performs the pumping operation in accordance with the oscillation signal OSC from the oscillation circuit 10 and supplies the substrate voltage Vbb to the memory cell unit 1. When the substrate voltage Vbb from the pumping unit 20 that is sensed by the level sensing unit 30 becomes a predetermined level, which is the sensing point, the level sensing unit 30 generates the sensing signal OSCSW to suspend the oscillation circuit 10. When the substrate voltage Vbb is under the predetermined level, the level sensing unit 30 outputs the sensing signal OSCSW to continuously drive the oscillation circuit 10. The sensing point is a predetermined level.

As shown in FIG. 3, when a level A of the substrate voltage Vbb from the pumping unit 20 is lower than the predetermined voltage level that is the sensing point, the sensing NMOS transistor N1 of the level sensing unit 30 is turned off. Thus, the oscillation circuit 10 is suspended. When a level B of the substrate voltage Vbb is higher than the predetermined voltage level, the sensing NMOS transistor N1 is turned on and outputs the substrate voltage Vbb. Accordingly, the oscillation circuit 10 is again operated. Here, the sensing point or the predetermined voltage level of the level sensing unit 30 is determined by the turn-on voltage of the sensing NMOS transistor N1.

The operation of the oscillation circuit 10 is controlled in accordance with the sensing signal OSCSW outputted from the level sensing unit 30. Thus, the substrate voltage applying circuit supplies the constant substrate voltage Vbb to the memory cell unit 1.

The memory cell of the related art semiconductor device has the P-well that is in the deep N-well. Thus, in a level test of a wafer, the substrate voltage applying circuit is suspended, and a power source at a desirable level is externally applied to an substrate voltage input pad.

However, as described above, the related art triple well memory cell and peripheral circuit and the related art substance voltage applying circuit have various disadvantages. Externally changing and supplying the substrate voltage when a semiconductor package is completely fabricated is difficult or impossible. Further, evaluation according to the substrate voltage is difficult or can not be achieved in the case of analyzing inferior memory cells and determining properties of memory cells.

The above references are incorporated by reference herein where appropriate for appropriate teachings of additional or alternative details, features and/or technical background.

SUMMARY OF THE INVENTION

An object of the present invention is to provide a substrate voltage applying circuit that substantially obviates one or more of the problems caused by limitations and disadvantages of the related art.

Another object of the present invention is to provide a substrate voltage applying circuit that selectively controls a substrate voltage level supplied to a semiconductor device.

Another object of the present invention is to provide a substrate voltage applying circuit that selectively controls a substrate voltage level supplied to a memory cell unit of a semiconductor device by sensing substrate voltages with a plurality of prescribed sensing points.

Another object of the present invention is to provide a substrate voltage applying circuit that selects a substrate voltage in accordance with an external sensing level selecting signal.

Another object of the present invention is to provide a substrate voltage applying circuit that selectively generates a substrate voltage desired by a triple well semiconductor device.

Another object of the present invention is to provide a substrate voltage generator that allows analysis of inferior memory cells to determine cell properties during testing.

To achieve at least these and other advantages in a whole or in parts and in accordance with the purpose of the present invention, as embodied and broadly described, a circuit for controlling an oscillation circuit unit coupled to a pumping unit that provides a substrate voltage is provided that includes a level sense unit and a vendor test mode generating unit that codes input signals and outputs sense level selecting signals to the level sense unit, wherein the level sense unit senses a level of a substrate voltage by a plurality of prescribed sensing points and outputs a corresponding sensing signal for controlling the oscillation circuit according to the sense level selecting signals from the vendor test mode generating unit.

To further achieve the above objects in a whole or in parts, a substrate voltage applying circuit of a semiconductor device is provided according to the present invention that includes a unit that applies a substrate voltage to the semiconductor device based on a first control signal, a generator unit that generates sense level selecting signals according to second control signals and a level sense unit coupled to the semiconductor device that senses a level of the substrate voltage using a plurality of prescribed sensing points and outputs the first control signal.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
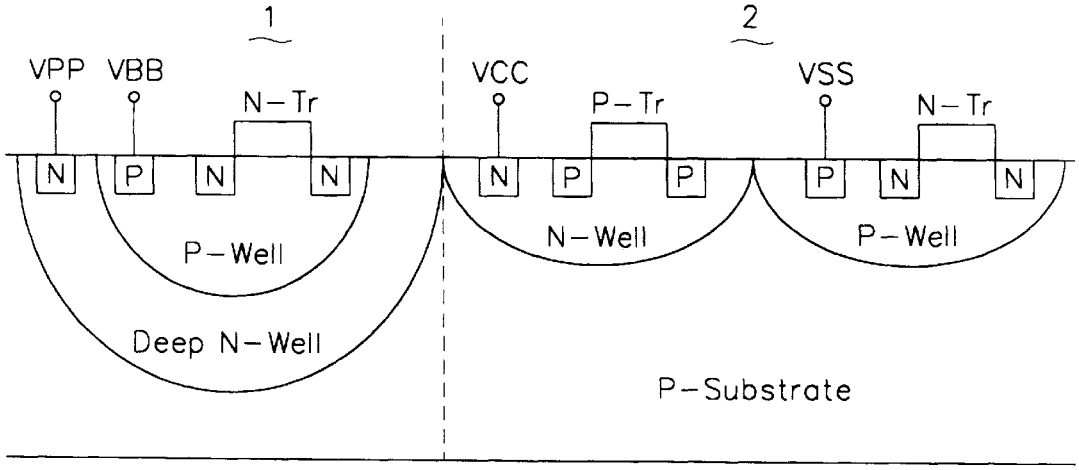
FIG. 1 BACKGROUND ART
FIG. 1 is a diagram showing cross-sectional view of a related art semiconductor device using a triple-well process.
Figure 2:
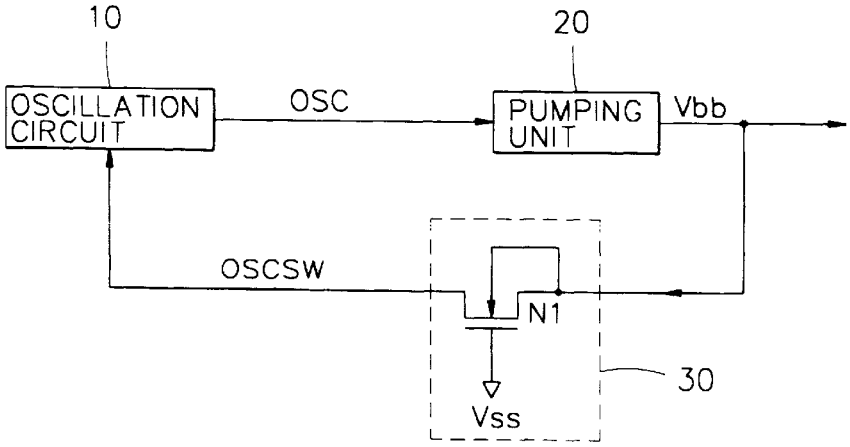
FIG. 2 BACKGROUND ART
FIG. 2 is a block diagram showing a related art substrate voltage applying circuit.
Figure 3:
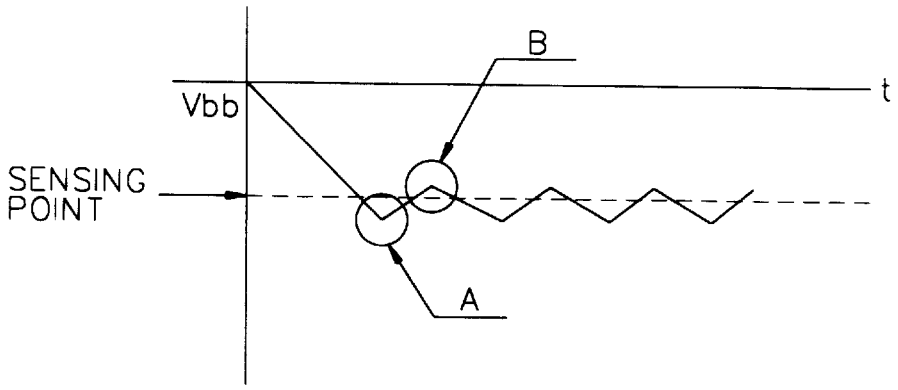
FIG. 3 BACKGROUND ART
FIG. 3 is a diagram showing a sensing point of a level sensing unit in FIG. 2.
Figure 4:
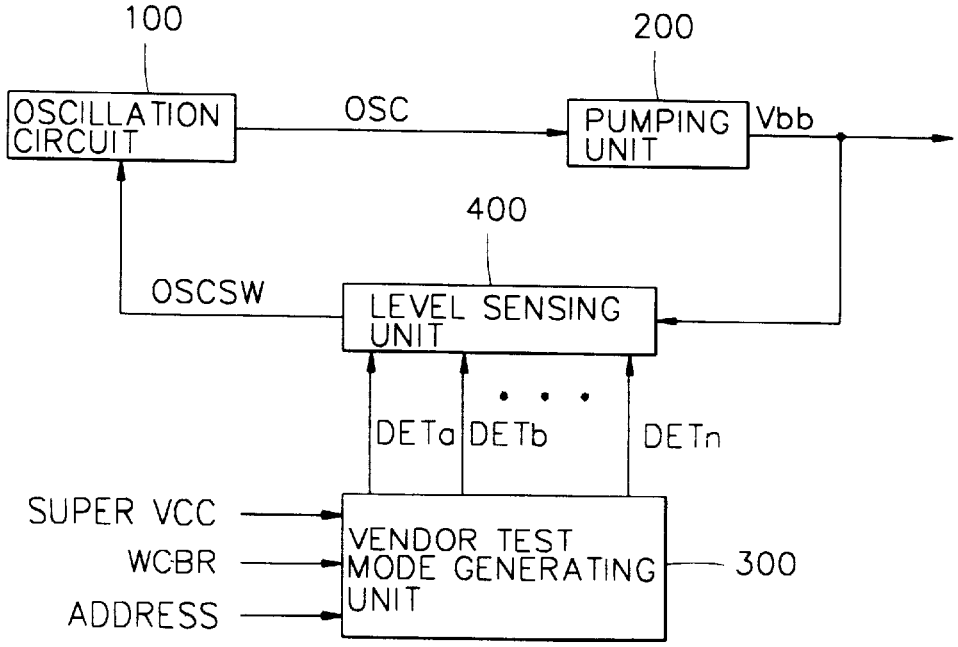
FIG. 4 is a block diagram showing a preferred embodiment of a substrate voltage applying circuit according to the present invention.

FIG. 4 is a block diagram showing a preferred embodiment of a substrate voltage applying circuit according to the present invention. As shown in FIG. 4, the preferred embodiment of the substrate voltage applying circuit includes an oscillation circuit unit 100, a pumping unit 200, a vendor test mode generating unit 300 and a level sensing unit 400.

The oscillation circuit unit 100 and the pumping unit 200 can respectively use conventional circuits for an oscillating operation and for a pumping operation. Accordingly, a detailed description is omitted.

The vendor test mode generating unit 300 codes a WCBR signal, a high level power source voltage SUPERVCC, and an address signal preferably received from external devices (not shown). The vendor test mode generating unit 300 generates sense level selecting signals DETa-DETn.

Figure 5:
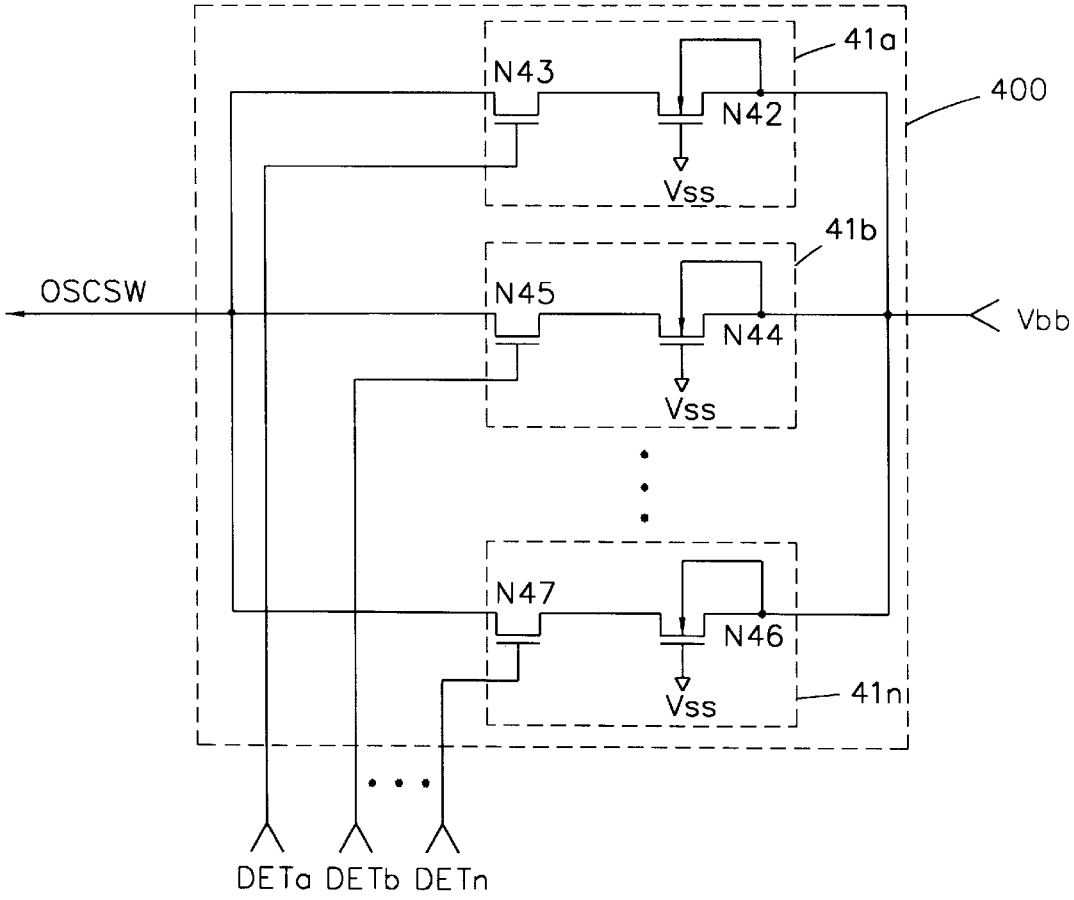
FIG. 5 is a circuit diagram showing a level sensing unit in FIG. 4.

FIG. 5 is a diagram that illustrates the level sensing unit 400. As shown in FIG. 5, a plurality of level sense terminals 41*a*–41*n* are arranged in parallel between an input terminal and an output terminal. The level sense terminals 41*a*–41*n* respectively sense a substrate voltage Vbb from the pumping unit 200 and output a sensing signal OSCSW at a predetermined level in accordance with the corresponding sense level selecting signals DETa-DETn supplied from the vendor test mode generating unit 300.

Each of the level sense terminals 41*a*–41*n* preferably includes a sensing NMOS transistor having a source and a substrate that receive the substrate voltage Vbb and a gate that receives a ground voltage Vss, and a switching NMOS transistor. Each of the switching NMOS transistors preferably has a source coupled to a drain of the sensing NMOS transistor, a drain coupled to the oscillation circuit unit 100, and a gate that receives a corresponding one of the sense level selecting signals DETa-DETn from the vendor test mode generating unit 300. For example, the level sense terminal 41*a* includes NMOS sensing transistor N42 and NMOS switching transistor N43.

As shown in FIG. 5, although the level sense terminals 41*a*–41*n* have a similar construction, each element is labeled with a different reference number. Sensing NMOS transistors N42, N44, N46 of the level sense terminals 41*a* –41*n* have a different size to obtain various sensing results of a variable level of the substrate voltage Vbb.

Operations of the preferred embodiment of the substrate voltage applying circuit according to the present invention will now be described. First, the oscillation circuit unit 100 generates an oscillation signal OSC, and the pumping unit 200 pumps according to the oscillation signal OSC and supplies the substrate voltage Vbb to a memory cell unit.

The level sense unit 400 senses a voltage level of the substrate voltage Vbb supplied from the pumping unit 200 by a plurality of sensing points and outputs a sensing signal OSCSW at a corresponding level to the oscillation circuit unit 100 in accordance with the sense level selecting signals DETa-DETn from the vendor test mode generating unit 300. The sensing points of the level sense unit 400 are determined for example by the different sized sensing NMOS transistors N42, N44, N46 in the level sense terminals 41*a*–41*n*. One of the level sense terminals 41*a*–41*n* is selected by the sense level selecting signals DETa-DETn.

For instance, if the sense level selecting signals DETa-DETn from the vendor test mode generating unit 300 are "1, 0, . . . , 0,", the switching NMOS transistor N43 of the level sense terminal 41*a* is turned on. Thus, the first level sense terminal 41*a* is selected. Accordingly, the sensing signal OSCSW is outputted based on a sensing point determined by a size of the sensing NMOS transistor N42 of the selected level sense terminal 41*a*. In addition, the oscillation circuit unit 100 supplies the oscillation signal OSC or a suspending signal to the pumping unit 200 according to the sensing signal OSCSW. The above-described operation relates to the case where only the level sense terminal 41*a* is selected among the level sense terminals 41*a*–41*n* in accordance with the sense level selecting signals DETa-DETn from the vendor test mode generating unit 300.

When the level sense terminal 41*b* or plural level sense terminals among the level sense terminals 41*a*–41*n* are selected, the sensing signal OSCSW of the level sense unit 400 is changed. In this case, eventually the pumping unit 200 supplies the substrate voltage Vbb that has a different level from the previously generated substrate voltage Vbb to the memory cell unit.

Figure 6:
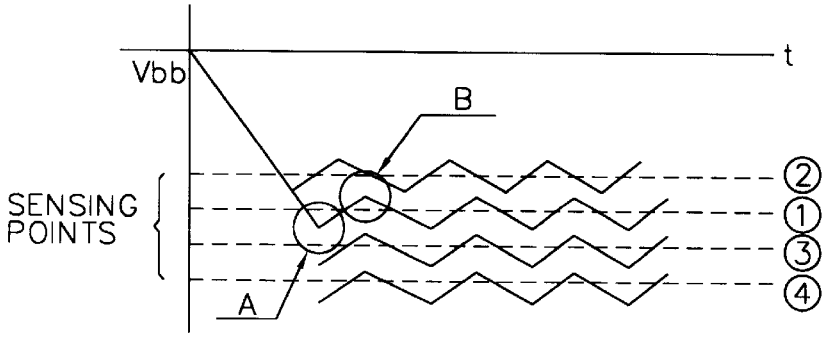
FIG. 6 is a diagram showing a plurality of sensing points of a level sensing unit in FIG. 4.

FIG. 6 illustrates various states of the level sense unit 400 in accordance with the sensing points that are selected by the sense level selecting signals DETa-DETn from the vendor test mode generating unit 300. In FIG. 6, sensing point 1 indicates general sensing points and sensing point 2 indicates sensing points that are arbitrarily controlled higher by the sense level selecting signals (DETa-DETn) from the vendor test mode generating unit 300. Sensing point 3 indicates sensing points that are arbitrarily controlled lower than the sensing point 1 by the sense level selecting signals (DEta-DEtn) from the vendor test mode generating unit 300. Sensing point 4 indicates sensing points that are arbitrarily controlled lower than sensing point 3 by the sense level selecting signals (DETa-DETn) from the vendor test mode generating unit 300. Accordingly, each of points A and B in FIG. 6 are sensing points at which the oscillation circuit unit 100 is preferably operated or suspended by changes of the sensing points.

The vendor test mode generating unit 300 codes the WCBR signal, the high level power source voltage SUPERVCC, and the address signal, which are preferably externally supplied. The vendor test mode generating unit 300 further outputs the sense level selecting signals DETa-DETn to the level sense unit 400. The sense level selecting signals DETa-DETn supplied to the level sense unit 400 enable the switching NMOS transistors N43, N45, . . . , N47 of the level sense terminals 41*a*–41*n* to select the level sense terminal having the corresponding sensing point. The number of the level sense terminals 41*a*–41*n* is preferably determined by the number of bits of the sense level selecting signals DETa-DETn.

The WCBR signal preferably indicates that a write enable signal is inputted before a CAS signal in the operation of a memory device, and the high level power source voltage SUPERVCC is an arbitrary voltage applied to a vendor test (e.g., over 6V).

Thus, at least one level sense terminal 41*a*–41*n* is selected by the sense level selecting signals DETa-DETn from the vendor test mode generating unit 300, and a different sensing signal OSCSW is generated in accordance with the selected level sense terminal 41*a*–41*n*. The substrate voltage Vbb generated from the pumping unit 200 has a different level in accordance with the sense level selecting signals DETa-DETn from the vendor test mode generating unit 300. That is; although the semiconductor package is fabricated, the substrate voltage Vbb may be controlled to be lower or higher than a preset or initial level of a substrate voltage.

As described above, the preferred embodiment of a substrate voltage applying circuit has various advantages. With the preferred embodiment of the substrate voltage applying circuit, a level of the substrate voltage may be controlled even though the semiconductor package is completely fabricated. Thus, analyzing inferior memory cells and evaluating properties of memory cells can be performed using the preferred embodiment of a substrate voltage applying circuit. Further, yield and properties of the memory cells can be increased and improved, respectively.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A circuit for controlling an oscillation circuit coupled to a pumping unit that provides a substrate voltage, the circuit comprising:

a level sense unit; and a vendor test mode generating unit that outputs sense level selecting signals to the level sense unit, wherein the level sense unit senses a level of the substrate voltage by a plurality of prescribed sensing points and outputs a corresponding sensing signal for controlling the oscillation circuit according to the sense level selecting signals from the vendor test mode generating unit, wherein the level sense unit comprises a plurality of level sense terminals connected in parallel, wherein each of the plurality of level sense terminals senses the substrate voltage from the pumping unit using a corresponding one of the sensing points.

2. The circuit of claim 1, wherein the substrate voltage is varied by enabling a corresponding level sense terminal based on the sense level selecting signals.

3. The circuit of claim 1, wherein each of the level sense terminals comprises:

a sensing transistor having a first electrode and a substrate that receive the substrate voltage and a control electrode that receives a first prescribed voltage; and a switching transistor having a first electrode coupled to a second electrode of the sensing transistor, a second electrode coupled to the oscillation circuit, and a control electrode that receives a corresponding one of the sense level selecting signals from the vendor test mode generating unit.

4. The circuit of claim 3, wherein each of the sensing and switching transistors is an NMOS transistor, wherein the control, first and second electrodes are respectively gate, source and drain electrodes, wherein the first prescribed voltage is a ground voltage, and wherein the substrate voltage is determined by a selected one of the plurality of level sense terminals.

5. The circuit of claim 3, wherein the sensing points are determined by the sensing transistors of the plurality of level sense terminals, wherein each of the sensing transistors respectively has a different size.

6. The circuit of claim 5, wherein the width and length dimensions of each of the sensing transistors is varied to obtain the different sizes.

7. The circuit of claim 1, wherein each of the level sense terminals comprises a sensing unit and a switching unit.

8. The circuit of claim 1, wherein the vendor test mode generating unit outputs the sense level selecting signals by coding a first signal, a prescribed voltage and an address signal.

9. The circuit of claim 8, wherein the first signal is a WCBR signal and the prescribed voltage is a high-level power source voltage, and wherein the address signal, the WCBR signal and the high-level power source voltage are externally supplied to the circuit.

10. A substrate voltage applying circuit of a semiconductor device, comprising:

a substrate voltage unit that applies a substrate voltage to the semiconductor device based on a first control signal;

a generator that generates sense level selecting signals according to second control signals; and a level sensor, coupled to the substrate voltage unit and the generator, that senses a level of the substrate voltage provided by the substrate voltage unit using a prescribed sensing point among a plurality of prescribed sensing points which is determined based on the sense level selecting signals and outputs the first control signal, wherein the level sensor comprises a plurality of level sense terminals coupled in parallel, wherein each of the plurality of level sense terminals senses the substrate voltage using a corresponding one of the prescribed sensing points.

11. The circuit of claim 10, wherein the substrate voltage is varied by enabling a corresponding sense terminal based on the sense level selecting signals.

12. The circuit of claim 10, wherein each of the level sense terminals comprises:

a sensing transistor having a first electrode and a substrate that receive the substrate voltage and a control electrode that receives a first prescribed voltage; and a switching transistor having a first electrode coupled to a second electrode of the sensing transistor, a second electrode coupled to the substrate voltage unit, and a control electrode that receives a corresponding one of the sense level selecting signals from the generator unit, wherein the sensing points are determined by the sensing transistors of the plurality of level sense terminals, wherein each of the sensing transistors respectively has a different size, and wherein a selected one of the different sized sensing transistors determines the substrate voltage.

13. The circuit of claim 12, wherein the generator encodes the second control signals that are externally supplied to generate the sense level selecting signals, and wherein the level sensor outputs the first control signal using a corresponding one of the level sense terminals.

14. The circuit of claim 10, wherein the substrate voltage unit comprises:

an oscillator that outputs an oscillation signal based on the first control signal; and a pumping circuit that performs a pumping operation based on the oscillation signal to output the substrate voltage, and wherein the generator is a vendor test mode generator.

15. A circuit for controlling an oscillation circuit coupled to a pumping unit that provides a substrate voltage, the circuit comprising:

a level sensor; and a vendor test mode generator that codes input signals and outputs sense level selecting signals to the level sensor, wherein the level sensor senses a level of the substrate voltage by a plurality of prescribed sensing points and outputs a corresponding sensing signal for controlling the oscillation circuit according to the sense level selecting signals from the vendor test mode generator, wherein the vendor test mode generator outputs the sense level selecting signals by coding a first signal, a prescribed voltage and an address signal, which are the input signals.

16. A substrate voltage applying circuit of a semiconductor device, comprising:

a substrate voltage unit that applies a substrate voltage to the semiconductor device based on a first control signal;

a generator that generates sense level selecting signals by coding second control signals; and a level sensor coupled to the substrate voltage unit and the generator to sense a level of the substrate voltage provided by the substrate voltage unit using a sensing point among a plurality of prescribed sensing points which is determined based on the sense level selecting signals and outputting the first control signal, wherein the generator generates the sense level selecting signals by coding a first signal, a prescribed voltage and an address signal, which are the second control signals.

17. A circuit for controlling an oscillation circuit coupled to a pumping unit that provides a substrate voltage, the circuit comprising:

a level sensor; and a vendor test mode generator that outputs sense level selecting signals to the level sensor, wherein the level sensor senses a level of the substrate voltage by a plurality of prescribed sensing points and outputs a corresponding sensing signal for controlling the oscillation circuit according to the sense level selecting signals from the vendor test mode generator, wherein the level sensor comprises a plurality of level sense terminals coupled to each other, wherein each of the plurality of level sense terminals senses the substrate voltage from the pumping unit using a corresponding one of the sensing points and each level sense terminal includes a first transistor and a second transistor coupled to one another, wherein each second transistor of the plurality of level sense terminals has a different transistor size to allow the level sensor for sensing the plurality of prescribed sensing points.

* * * * *